US006540548B1

(12) United States Patent
Zhang

(10) Patent No.: US 6,540,548 B1
(45) Date of Patent: Apr. 1, 2003

(54) METHOD AND APPARATUS FOR SEPARATING METALLIC BRAID FROM CORE WIRE OF A COAXIAL CABLE

(75) Inventor: Jun-Wu Zhang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/097,670

(22) Filed: Mar. 13, 2002

(51) Int. Cl.[7] ..... H01R 12/24

(52) U.S. Cl. ..... 439/493; 439/63; 439/581; 439/98; 439/610; 174/88 R

(58) Field of Search ..... 439/63, 580, 493, 439/579, 581, 98, 610; 174/88 R

(56) References Cited

U.S. PATENT DOCUMENTS 5,829,991 A * 11/1998 Murphy et al. ..... 439/98
5,931,698 A * 8/1999 Kodama ..... 439/578
6,212,422 B1 * 4/2001 Berg et al. ..... 600/435
6,371,805 B1 * 4/2002 Wang et al. ..... 439/581

* cited by examiner

*Primary Examiner*—P. Austin Bradley
*Assistant Examiner*—Truc Nguyen
(74) *Attorney, Agent, or Firm*—Wei Te Chung

(57) ABSTRACT

A method for separating a metallic braid from a core wire of a micro coaxial cable during connecting the coaxial cable to a printed circuit board (PCB) is disclosed. The coaxial cable includes a sheath surrounding the metallic braid and the inner conductor. An apparatus for performing the method includes a rotiform brush, a spin shaft extending through the rotiform brush and an electrical motor for driving the spin shaft and the rotiform brush. The rotiform brush includes a circular frame and a plurality of densely arranged hard brushings attached to the frame. The method comprising the following steps: (i) extending the coaxial cable through corresponding hole formed in the PCB; (ii) stripping a predetermined length of the sheath of the coaxial cable to expose the braid; (iii) moving the PCB with the cable towards the rotiform brush until the exposed metallic braid of the coaxial cable gets contact with the brushings; (iv) rotating the rotiform brush to urge the metallic braid and the core wire in the rotating direction and thus separating the braids from the core wire along a tangent direction of the rotiform brush.

2 Claims, 5 Drawing Sheets

METHOD AND APPARATUS FOR SEPARATING METALLIC BRAID FROM CORE WIRE OF A COAXIAL CABLE

BACKGROUND OF THE INVENTION

1. Field of the Invention

The present invention relates to a method for separating a metallic braid from a core wire of a coaxial cable, and an apparatus thereof.

2. Description of the Related Art

Micro coaxial cables are widely used in signal transmission for its small size, high tensile strength, good performance of electrical specification and Anti-EMI (Electro Magnetic Interference). FIGS. 1 and 2 of attached drawings show a micro coaxial cable 1 comprising an inner conductor 11 surrounded by an insulating jacket 12, a metallic braid 13 surrounding the insulating jacket 12 and an insulating sheath 14 encompassing the coaxial cable 1.

The electrical connection between a coaxial cable and an electrical connector is done by means of soldering or Insulation Displacement Contact (IDC) technique. The IDC technique is not proper for the micro coaxial cable, for when the insulating sheath 14 and the insulting jacket 12 are fierced through by sharpened edges of a conductive contact of an IDC type connector, both the inner conductor 11 and the metallic braid 13 are simultaneously contacted by the contact. Hence it is necessary to separate the metallic braid 13 and the inner conductor 11 before the coaxial cable is soldered to the connector. Heretofore, the cables are separated by hands in a one by one fashion, it is both time and labor consuming because the metallic braid 13 consists of a lot of copper wires, and the diameter of each wire is only about 0.025–0.05 mm. Moreover, the quality is poor when it is done purely by hands. Thus, it is necessary to provide an apparatus and method to separate the core wire from the metallic braid of a coaxial cable when the coaxial cable is connected to an electrical connector.

SUMMARY OF THE INVENTION

Accordingly, it is an object of the present invention to provide a method for separating the metallic braid from the core wire of a coaxial cable.

It is another object of the present invention to provide an apparatus for separating the metallic braid from the core wire of a coaxial cable in connecting the coaxial cable to a printed circuit board (PCB).

To achieve the above objects, a method in accordance with the present invention for separating a metallic braid from a core wire of a micro coaxial cable during connecting the cable to a PCB comprising the following steps: (i) extending the coaxial cable through corresponding hole formed in the PCB; (ii) stripping a predetermined length of the sheath of the coaxial cable to expose the metallic thread; (iii) providing a rotiform brush mechanism comprising a rotiform brush, a spin shaft extends through the rotiform brush and an electrical motor for urging the spin shaft and the brush to rotate, the rotiform brush comprising a circular frame and a plurality of hard brushings attached to the circular frame; (iv) moving the PCB with the stripped coaxial cable towards the rotiform brush until the coaxial cable gets contact with the brushings of the rotiform brush; (v) rotating the rotiform brush to urge the coiling threads of the metallic braid and the core wire in the rotating direction, and thus separating the braid and the core wire along a tangent direction of the rotiform brush.

Other objects, advantages and novel features of the invention will become more apparent from the following detailed description of preferred embodiment thereof when taken in conjunction with the accompanying drawings, wherein:

DETAILED DESCRIPTION OF PREFERRED EMBODIMENTS

Figure 2:
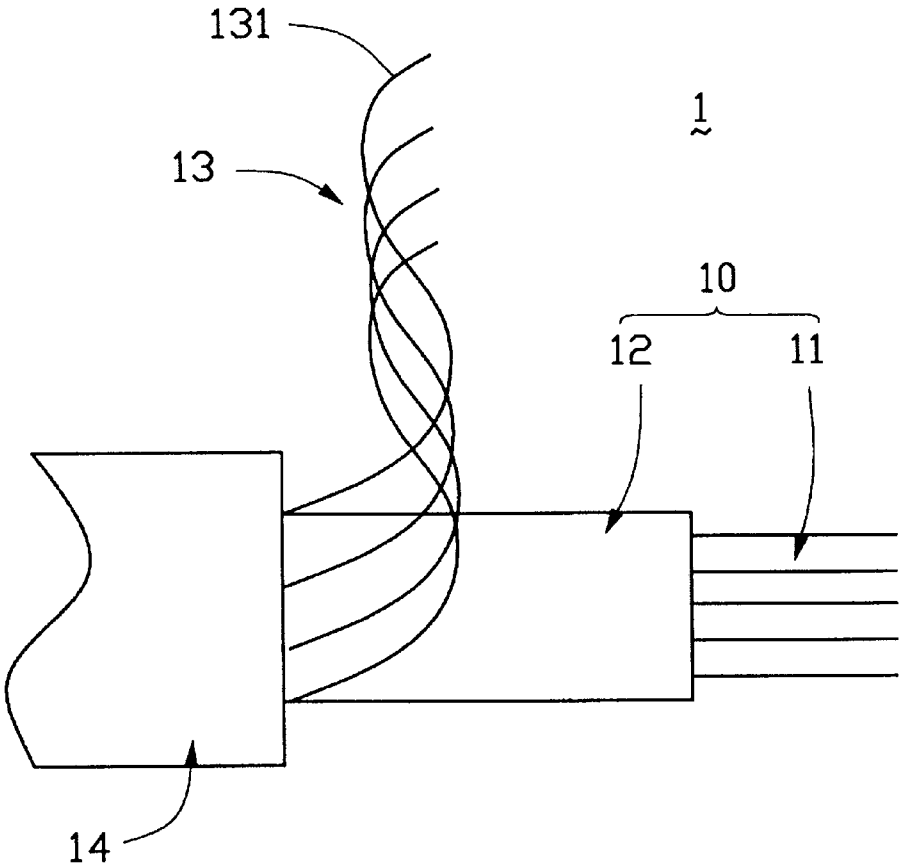
FIG. 2 (PRIOR ART)
FIG. 2 is a structural view of the micro coaxial cable of FIG. 1.
Figure 1:
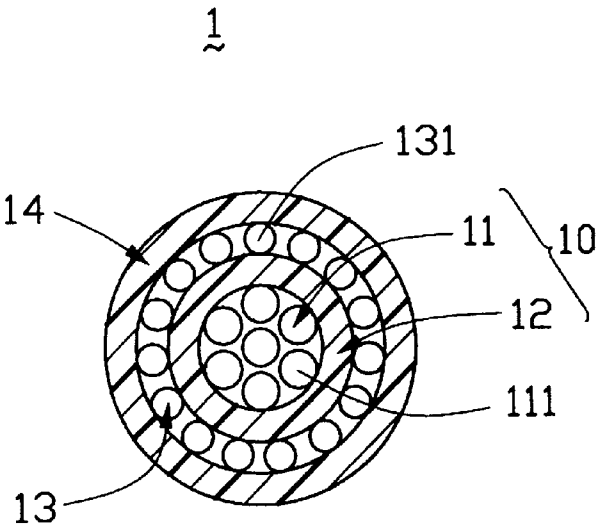
FIG. 1 (PRIOR ART)
FIG. 1 is a cross-sectional view of a micro coaxial cable in accordance with the present invention.

Referring to FIGS. 1 and 2, a micro coaxial cable 1 comprises a core wire 10 that is encircled by a metallic braid 13, which is surrounded by an insulating sheath 14 of polyvinyl chloride (PVC) material. The core wire 10 comprises an inner conductor 11 consisting of a plurality of copper alloy conductors 111, and a Teflon insulating jacket 12 surrounding the conductors 111. The metallic braid 13 consists of a plurality of net-shaped thin conductive coiling threads 131. Illustratively, the number of the conductors 111 and coiling threads 131 are respectively 7 and 15.

Figure 4:
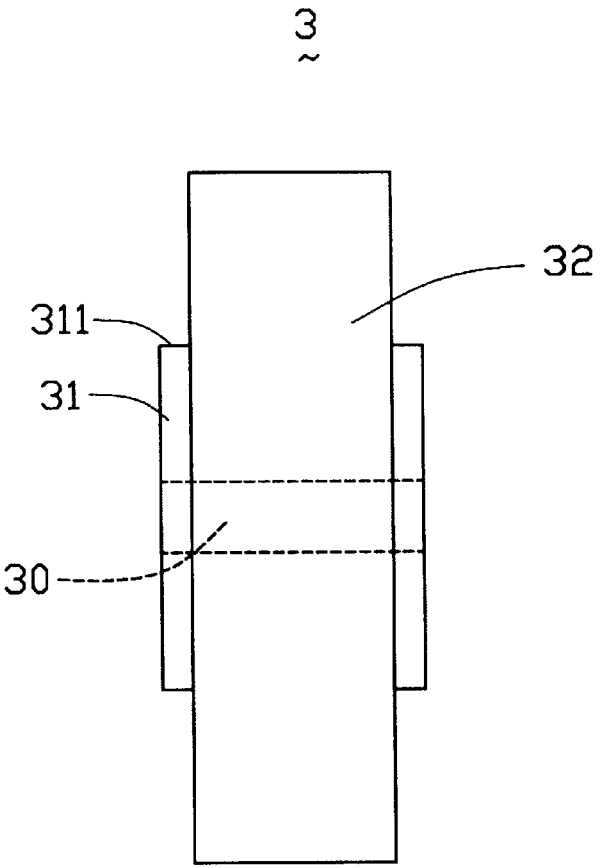
FIG. 4 is a side view of the rotiform brush in accordance with the present invention.
Figure 3:
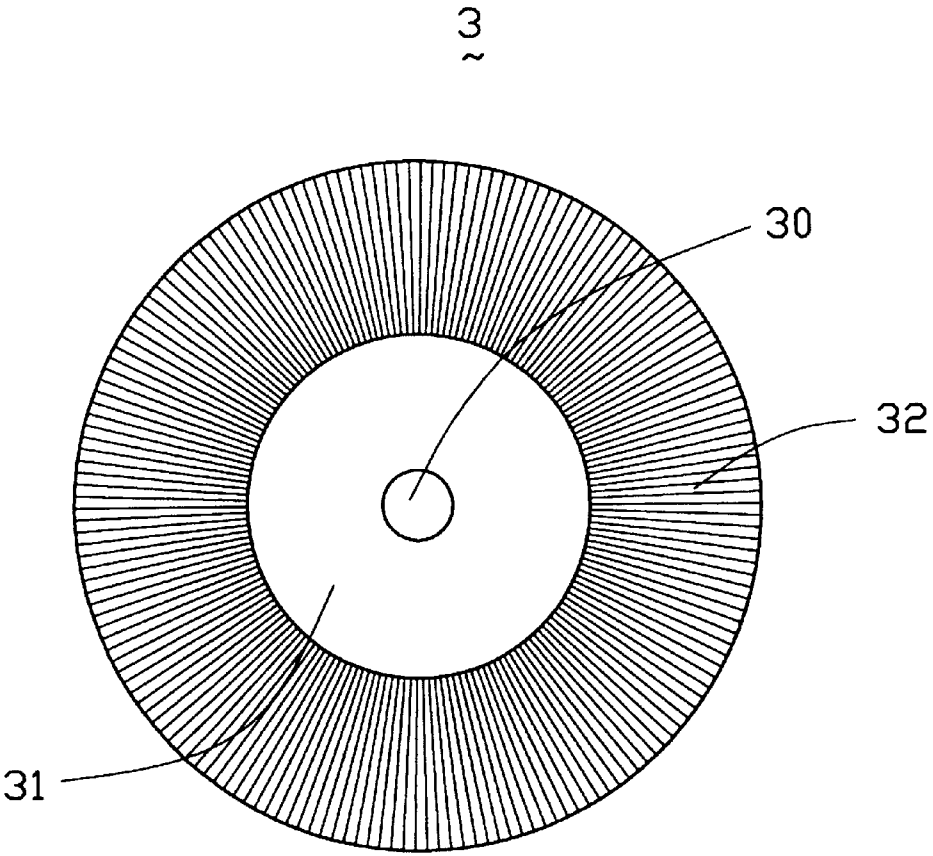
FIG. 3 is a front view of a rotiform brush in accordance with the present invention.

In accordance with the present invention, an apparatus used for separating the metallic braid 13 from the core wire 10 comprises a rotiform brush mechanism comprising a rotiform brush 3, shown in FIGS. 3 and 4. The rotiform brush 3 comprises a circular frame 31 defining a central hole 30 for a spin shaft (not shown) and a plurality of densely arranged hard brushings 32 attached to a circumferential surface 311 of the frame 31. Illustratively, the material of the hard bushing 32 is Nylon. The rotiform brush mechanism also comprises an electrical motor (not shown) for driving the spin shaft and the rotiform brush 3.

Figure 5:
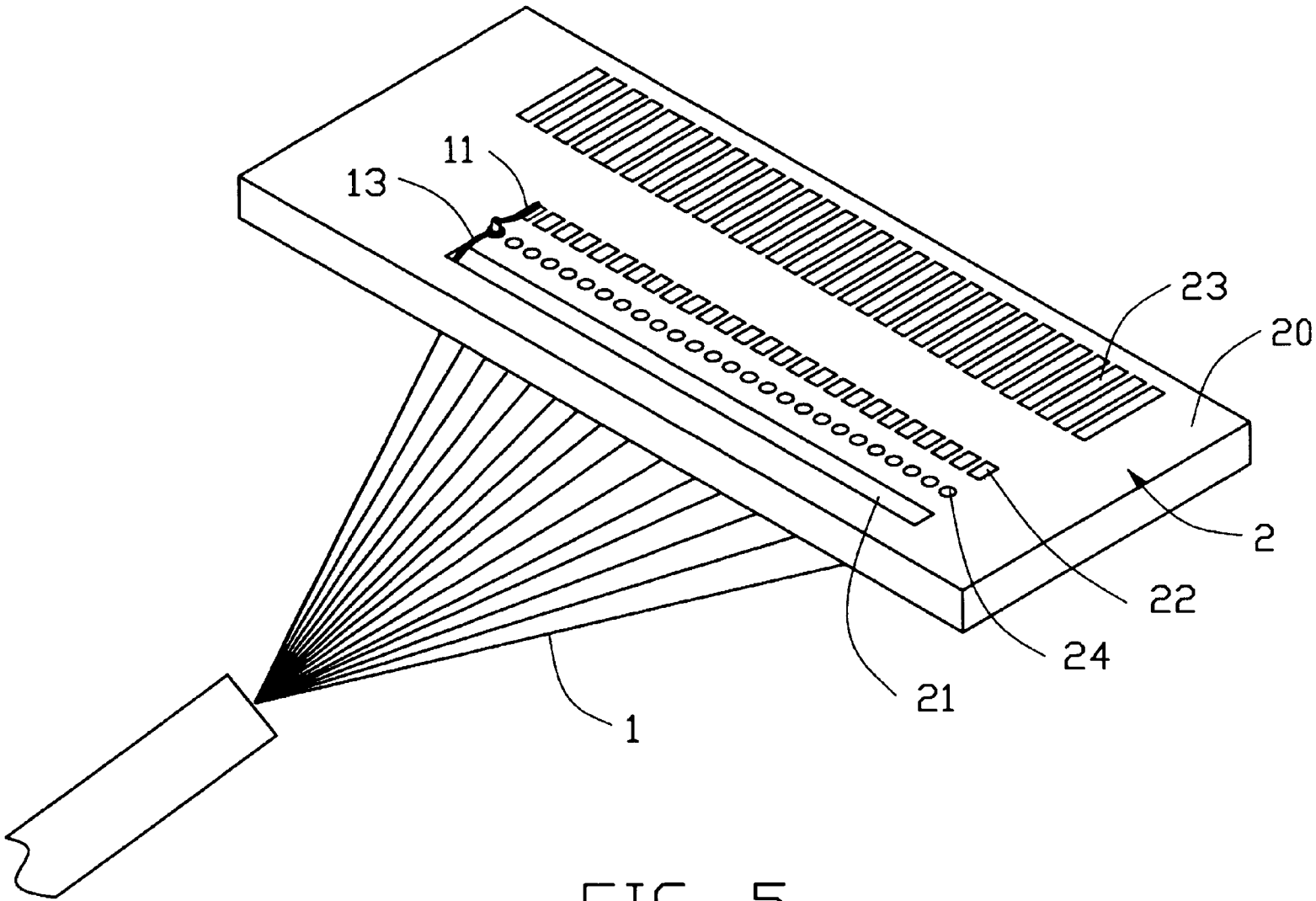
FIG. 5 is a perspective view showing the micro coaxial cable of FIG. 1 connected to a printed circuit board.

Referring to FIG. 5, a printed circuit board (PCB) 2 to which the cable 1 is to be connected has opposite top surface 20 and bottom surface (not labeled). A grounding pad 21 and a plurality of signal pads 3 are respectively formed on the top surface 20 of the PCB 2. A plurality of holes 24 corresponding to the signal pads 3 formed between the signal pads 3 and the grounding pad 21. A plurality of conductive pads 23 is also formed on the top surface 20 of the PCB 2.

To connect the cable 1 to the PCB 2, a number of cable 1 extend through the holes 24 of the PCB 2 from the bottom surface to the top surface 20. A predetermined length of the sheath 14 of each cable 1 is stripped to expose the corresponding length of the metallic braid 13.

Figure 6:
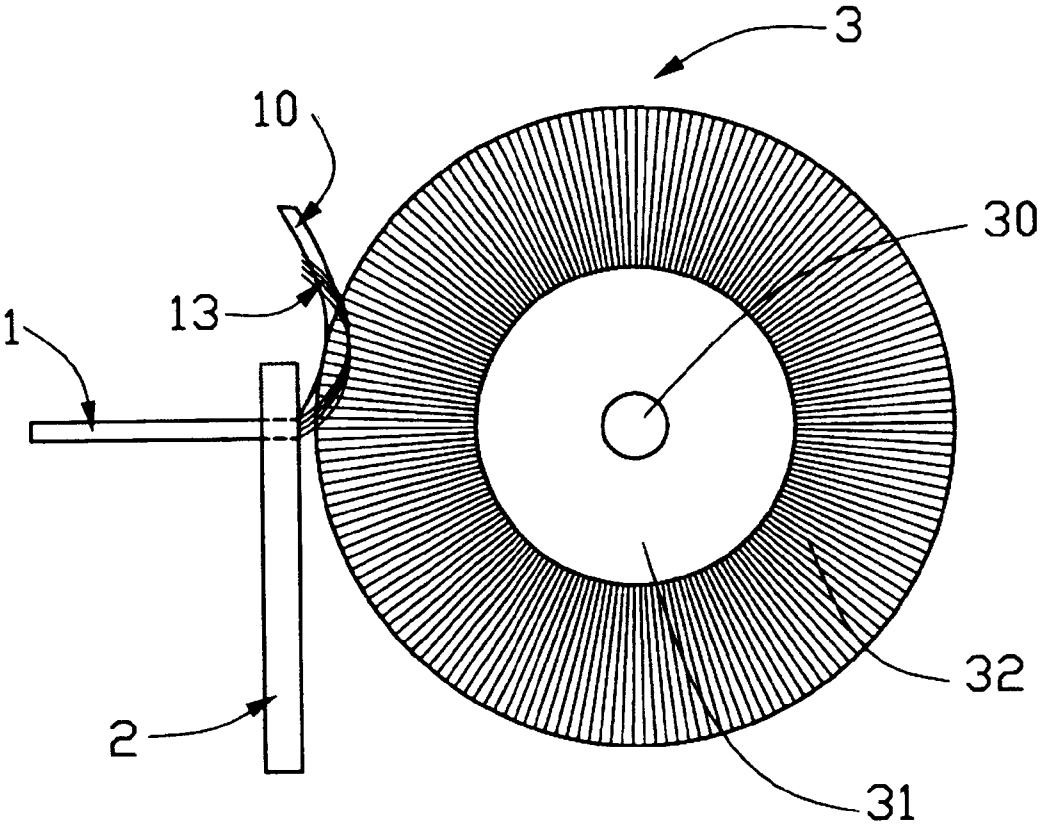
FIG. 6 is a front view showing the rotiform brush when moving towards a micro coaxial cable, wherein the metallic braid and the core wire are not separated.
Figure 7:
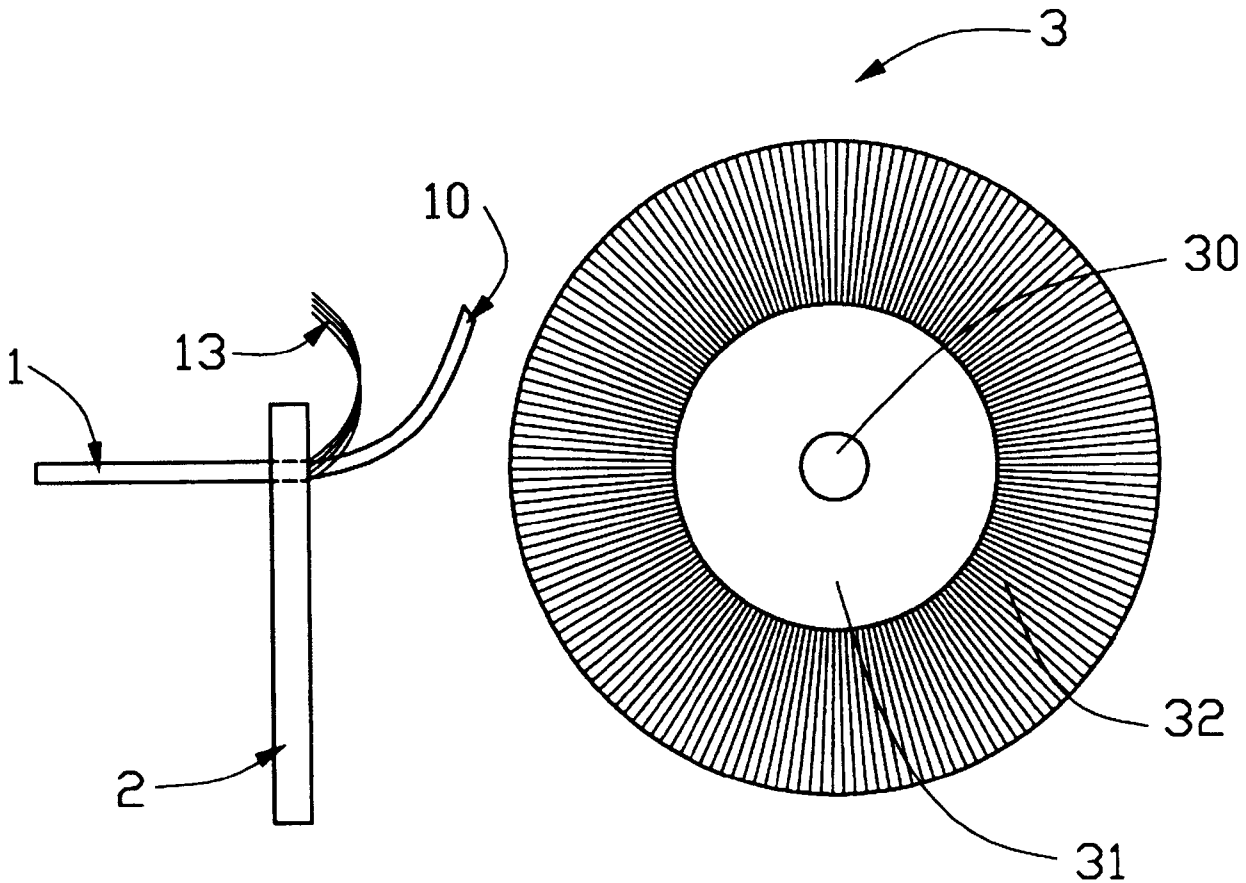
FIG. 7 is a front view showing the rotiform brush removing away from the micro coaxial cable after the core wire is separated from the metallic braid

Also referring to FIGS. 6 and 7, the PCB 2, together with the cable 1, is placed vertically in front of the rotiform brush 3, preferably by means of a carrier (not shown), with the top surface 20 of the PCB 2 facing the rotiform brush 3. The carrier is then moved toward the rotiform brush 3 until the exposed metallic braid 13 of the cable 1 gets contact with the brushings 32. By the rotation of the rotiform brush 3, the coiling threads 131 and the core wire 10 are urged upward by means of the brushings 32. Since the coiling threads 131 are substantially lighter than the core wire 10, the coiling threads 131 and the core wire 10 separate from each other along the tangent direction of the rotiform brush 3. The coiling threads 131 of the metallic braid 3 that are subject to certain plastic deformation are kept in a higher position than the core wire 10 after the rotiform brush 3 is removed (FIG. 7).

After the metallic braid 13 is separated from the core wire 10, the metallic braid 13 is soldered to the grounding pad 21 of the PCB 2 (FIG. 5). The inner conductors 11 of the core wire 10, after stripped a predetermined length of the insulating jacket 12, are soldered to the signal pads 22 of the PCB 2 in order to firm the connection thereof.

It is to be understood, however, that even thought characteristics and advantages of the present invention have been set forth in the foregoing description, together with details of the structure and function of the preferred embodiments of the invention, the disclosure is illustrative only, and changes may be made in detail, especially in matters of shape, size, and arrangement of parts within the principles of the invention to the full extent indicated by the board general meaning of the terms in which the appended claims are expressed. Understandably, this method and the corresponding apparatus for the coaxial cables can be applied to not only the printed circuit board but also the electrical connector.

What is claimed is:

1. In combination, a printed circuit board defining at least one through hole with at least two conductive pads thereabouts, a coaxial cable defined with a core wire enclosed by an metallic braid commonly extending through said through hole, said core wire including an inner conductor enclosed by an insulative jacket, a rotating brush first approaching the printed circuit board and engaging both said core wire and said braid to forcibly deflect both to extend along a tangent direction of rotation of said rotating brush, said rotating brush successively moving away from said printed circuit board to leave both of said core wire and said braid in a nature manner wherein said core wire is farther spaced from said printed circuit board than said braid due to stiffness thereof so as to separate said core wire and said braid from each other.

2. The combination as claimed in claim 1, wherein said braid is soldered on one of said pad, and the inner conductor is exposed to be soldered on the other pad.

* * * * *